US008029130B2

(12) United States Patent
Silverbrook

(10) Patent No.: US 8,029,130 B2
(45) Date of Patent: Oct. 4, 2011

(54) HAND-HELD PRINTER WITH CAPPING DEVICE

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 184 days.

(21) Appl. No.: 12/324,642

(22) Filed: Nov. 26, 2008

(65) Prior Publication Data

US 2009/0115813 A1 May 7, 2009

Related U.S. Application Data

(63) Continuation of application No. 11/739,056, filed on Apr. 23, 2007, now Pat. No. 7,470,021, which is a continuation of application No. 10/503,886, filed as application No. PCT/AU03/00154 on Feb. 12, 2003, now Pat. No. 7,252,379.

(30) Foreign Application Priority Data

Feb. 13, 2002 (AU) ..... PS0484

(51) Int. Cl.
*B41J 29/393* (2006.01)

(52) U.S. Cl. ..... 347/109

(58) Field of Classification Search ..... 347/109
See application file for complete search history.

(56) References Cited

U.S. PATENT DOCUMENTS

| | | | | |
|---|---|---|---|---|
| 5,028,934 | A | 7/1991 | Kasai et al. | |
| 5,235,353 | A * | 8/1993 | Hirano et al. | 346/145 |
| 5,443,320 | A | 8/1995 | Agata et al. | |
| 5,475,403 | A * | 12/1995 | Havlovick et al. | 705/33 |
| 5,816,718 | A | 10/1998 | Poole | |
| 5,825,995 | A | 10/1998 | Wiklof et al. | |
| 5,927,872 | A | 7/1999 | Yamada | |
| 5,988,900 | A | 11/1999 | Bobry et al. | |
| 6,015,211 | A * | 1/2000 | Kinoshita et al. | 347/109 |
| 6,062,686 | A | 5/2000 | Kinoshita et al. | |
| 6,092,941 | A | 7/2000 | Imai | |
| 6,312,124 | B1 | 11/2001 | Desormeaux | |
| 6,322,181 | B1 * | 11/2001 | Silverbrook | 347/2 |
| 6,357,939 | B1 | 3/2002 | Baron | |
| 6,517,266 | B2 | 2/2003 | Saund | |
| 2002/0030716 | A1 | 3/2002 | Watanabe et al. | |
| 2002/0093570 | A1 | 7/2002 | Silverbrook | |

FOREIGN PATENT DOCUMENTS

| | | | |
|---|---|---|---|
| DE | 3314041 | | 10/1984 |
| EP | 0036295 | A | 9/1981 |
| JP | 09-118048 | | 5/1997 |
| JP | 09277611 | A | 10/1997 |
| JP | 09-300724 | A | 11/1997 |
| JP | 10-006567 | | 1/1998 |
| JP | 10202953 | A | 8/1998 |
| JP | 11-028841 | | 2/1999 |
| JP | 2001-057586 | A | 2/2001 |
| WO | WO 03/068515 | A1 | 8/2003 |

* cited by examiner

*Primary Examiner* — Stephen D Meier
*Assistant Examiner* — Alexander C Witkowski

(57) ABSTRACT

A hand-held printer comprises an elongate body defining an ink ejection slot through which ink is ejected; an ink cartridge received in the body and defining a plurality of ink reservoirs storing respective types of ink; a movement sensor for sensing movement of the printhead module along print media; a printhead module in fluid communication with respective ink reservoirs, the printhead module including a printhead for ejecting ink through the ink ejection slot in accordance with the movement sensed by the movement sensor; and a capping device movable to expose or cover the printhead, the capping device including an elastomeric pad at an end thereof positioned to be in contact with nozzles of the printhead when the capping device covers the printhead.

5 Claims, 5 Drawing Sheets

HAND-HELD PRINTER WITH CAPPING DEVICE

CROSS-REFERENCES TO RELATED APPLICATIONS

The present application is a continuation application of U.S. application Ser. No. 11/739,056 filed on Apr. 23, 2007, now issued U.S. Pat. No. 7,470,021, which is a continuation of U.S. application Ser. No. 10/503,886 filed on Aug. 9, 2004, now issued as U.S. Pat. No. 7,252,379 which is a 371 of PCT/AU03/00154 filed on Feb. 12, 2003 all which are herein incorporated by reference

FIELD OF THE INVENTION

This invention relates to improvements in printer technology, and, in particular, relates to a manually moveable printer with a speed sensor which is adapted to print onto a page of print media as a user swipes the printer across the page.

BACKGROUND

Prior art printers typically incorporate a supply of print media into the printer and employ a print media feed mechanism to transport the print media past the printhead(s) to effect printing onto the print media. In such printers it is essential during a printing operation to synchronise the speed of the print media with the printing rate of the printhead(s) to ensure a faithful reproduction of the image being printed. Up until now the synchronisation of the print media with the printhead(s) has been relatively simple to accomplish because the print media feed mechanism, including the supply of print media, has been an integral part of the printer. The speed of the print media is therefore known and controllable, as is the speed at which the printhead(s) and print controller operate, with synchronisation between these features being accomplished using simple mechanical features such as gears, stepper motors and the like.

However, the need to have a supply of print media accommodated within the printer has made these printers larger and heavier than they otherwise need be. Similarly, the need for a print media drive mechanism integral to the printer to ensure proper synchronisation between ink ejection and print media transport has limited the minimum possible printer size.

CO-PENDING APPLICATIONS

Various methods, systems and apparatus relating to the present invention are disclosed in the following co-pending applications filed by the applicant or assignee of the present invention simultaneously with the parent application Ser. No. 11/739,056:

| | | |
|---|---|---|
| PCT/AU03/00154 | PCT/AU03/00151 | PCT/AU03/00150 |
| PCT/AU03/00145 | PCT/AU03/00153 | PCT/AU03/00152 |
| PCT/AU03/00168 | PCT/AU03/00169 | PCT/AU03/00170 |
| PCT/AU03/00162 | PCT/AU03/00146 | PCT/AU03/00159 |
| PCT/AU03/00171 | PCT/AU03/00149 | PCT/AU03/00167 |
| PCT/AU03/00158 | PCT/AU03/00147 | PCT/AU03/00166 |
| PCT/AU03/00164 | PCT/AU03/00163 | PCT/AU03/00165 |
| PCT/AU03/00160 | PCT/AU03/00157 | PCT/AU03/00148 |
| PCT/AU03/00156 | PCT/AU03/00155 | |

Related Patent Applications and Patents

| | | |
|---|---|---|
| 6,566,858 | 6,331,946 | 6,246,970 |
| 6,442,525 | PCT/AU01/00141 | 09/505,951 |
| PCT/AU01/00139 | 6,816,968 | 6,757,832 |
| PCT/AU01/00140 | PCT/AU00/00741 | 6,238,044 |
| PCT/AU00/00742 | 6,425,661 | 6,227,652 |
| 6,213,588 | 6,213,589 | 6,231,163 |
| 6,247,795 | 6,394,581 | 6,244,691 |
| 6,257,704 | 6,416,168 | 6,220,694 |
| 6,257,705 | 6,247,794 | 6,234,610 |
| 6,247,793 | 6,264,306 | 6,241,342 |
| 6,247,792 | 6,264,307 | 6,254,220 |
| 6,234,611 | 6,302,528 | 6,283,582 |
| 6,239,821 | 6,338,547 | 6,247,796 |
| 6,557,977 | 6,390,603 | 6,362,843 |
| 6,293,653 | 6,312,107 | 6,227,653 |
| 6,234,609 | 6,238,040 | 6,188,415 |
| 6,227,654 | 6,209,989 | 6,247,791 |
| 6,336,710 | 6,217,153 | 6,416,167 |
| 6,243,113 | 6,283,581 | 6,247,790 |
| 6,260,953 | 6,267,469 | 6,273,544 |
| 6,309,048 | 6,420,196 | 6,443,558 |
| 6,439,689 | 6,378,989 | 6,848,181 |
| 6,634,735 | PCT/AU98/00550 | PCT/AU00/00095 |
| 6,390,605 | 6,322,195 | 6,612,110 |
| 6,480,089 | 6,460,778 | 6,305,788 |
| PCT/AU00/00172 | 6,426,014 | PCT/AU00/00338 |
| 6,364,453 | PCT/AU00/00339 | 6,457,795 |
| PCT/AU00/00581 | 6,315,399 | PCT/AU00/00580 |
| 6,338,548 | PCT/AU00/00582 | 6,540,319 |
| PCT/AU00/00587 | 6,328,431 | PCT/AU00/00588 |
| 6,328,425 | PCT/AU00/00589 | 6,991,320 |
| PCT/AU00/00341 | 6,595,624 | PCT/AU00/00340 |
| PCT/AU00/00749 | 6,417,757 | PCT/AU01/01332 |
| 7,095,309 | PCT/AU01/01318 | 6,854,825 |
| PCT/AU00/00750 | 7,075,677 | PCT/AU00/00751 |
| 6,428,139 | PCT/AU00/00752 | 6,575,549 |
| PCT/AU01/00502 | PCT/AU00/00583 | 6,383,833 |
| PCT/AU02/01120 | PCT/AU00/00593 | 6,464,332 |
| PCT/AU00/00333 | PCT/AU00/01513 | 6,428,142 |
| PCT/AU00/00590 | 6,390,591 | PCT/AU00/00591 |
| 7,018,016 | PCT/AU00/00592 | 6,328,417 |
| PCT/AU00/00584 | 6,322,194 | PCT/AU00/00585 |
| 6,382,779 | PCT/AU00/00586 | 6,629,745 |
| PCT/AU00/01514 | 6,565,193 | PCT/AU00/01515 |
| 6,609,786 | PCT/AU00/01516 | 6,609,787 |
| PCT/AU00/01517 | 6,439,908 | PCT/AU00/01512 |
| 6,684,503 | PCT/AU00/00753 | 6,755,513 |
| PCT/AU00/00594 | 6,409,323 | PCT/AU00/00595 |
| 6,281,912 | PCT/AU00/00596 | 6,604,810 |
| PCT/AU00/00597 | 6,318,920 | PCT/AU00/00598 |
| 6,488,422 | PCT/AU01/01321 | 6,655,786 |
| PCT/AU01/01322 | 6,457,810 | PCT/AU01/01323 |
| 6,485,135 | PCT/AU00/00516 | 6,795,215 |
| PCT/AU00/00517 | 7,154,638 | PCT/AU00/00511 |
| 6,859,289 | PCT/AU00/00754 | 6,977,751 |
| PCT/AU00/00755 | 6,398,332 | PCT/AU00/00756 |
| 6,394,573 | PCT/AU00/00757 | 6,622,923 |

SUMMARY OF THE INVENTION

According to an aspect of the invention, a hand-held printer comprises an elongate body defining an ink ejection slot through which ink is ejected; an ink cartridge received in the body and defining a plurality of ink reservoirs storing respective types of ink; a movement sensor for sensing movement of the printhead module along print media; a printhead module in fluid communication with respective ink reservoirs, the printhead module including a printhead for ejecting ink through the ink ejection slot in accordance with the movement sensed by the movement sensor; and a capping device movable to expose or cover the printhead, the capping device including an elastomeric pad at an end thereof positioned to be in contact with nozzles of the printhead when the capping device covers the printhead.

BRIEF DESCRIPTION OF THE DRAWINGS

The invention will now be described by way of example only with reference to preferred embodiments and to the accompanying drawings in which:—

DETAILED DESCRIPTION OF PREFERRED AND OTHER EMBODIMENTS

Figure 1:
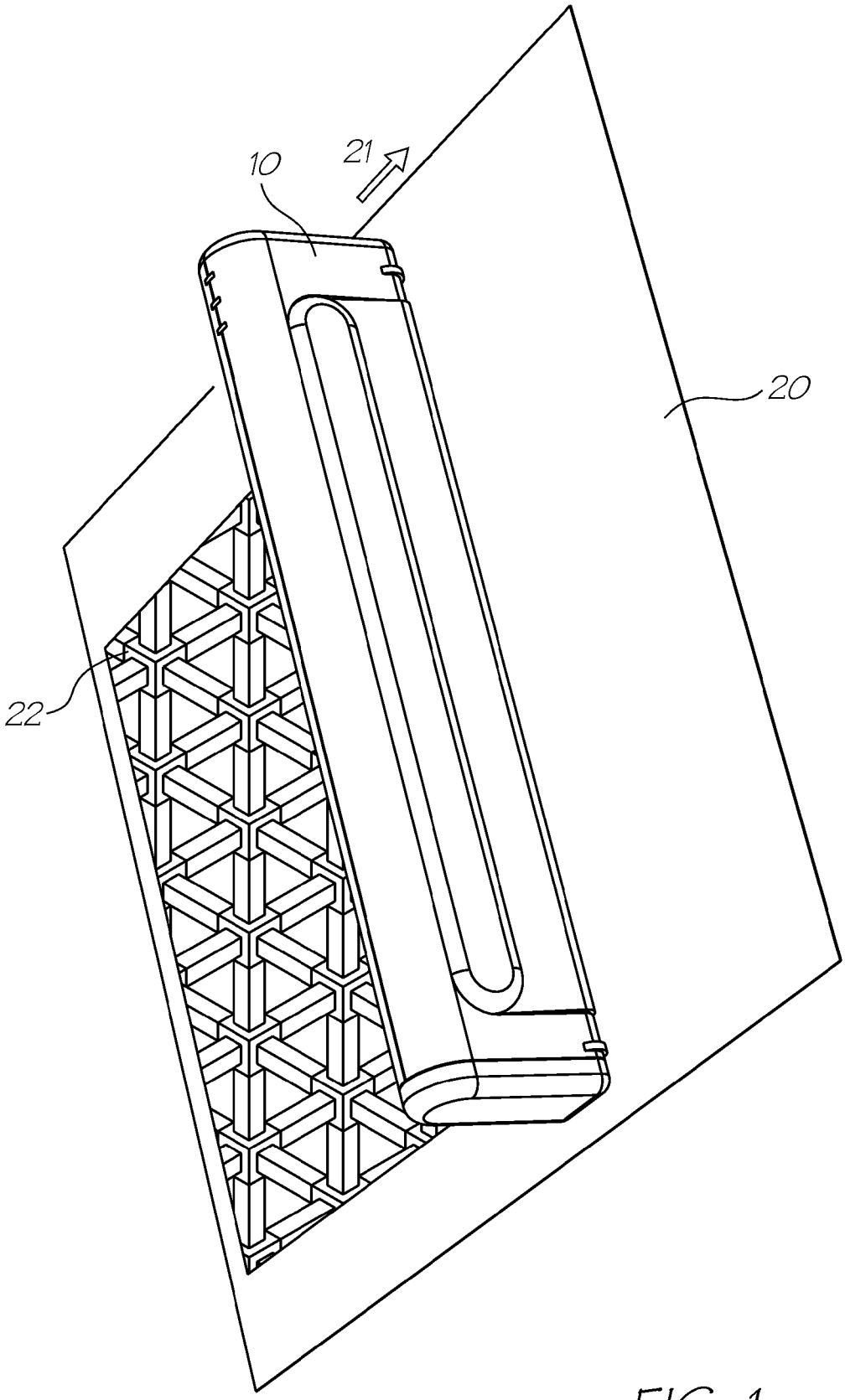
FIG. 1 is a perspective view of a preferred embodiment of a printer according to the invention, in use.

As shown in FIG. 1, a printer 10 according to a preferred embodiment of the invention prints an image 22 on the page 20 as it traverses the page in the direction of the arrow 21 under the guidance of a user (not shown).

Figure 2:
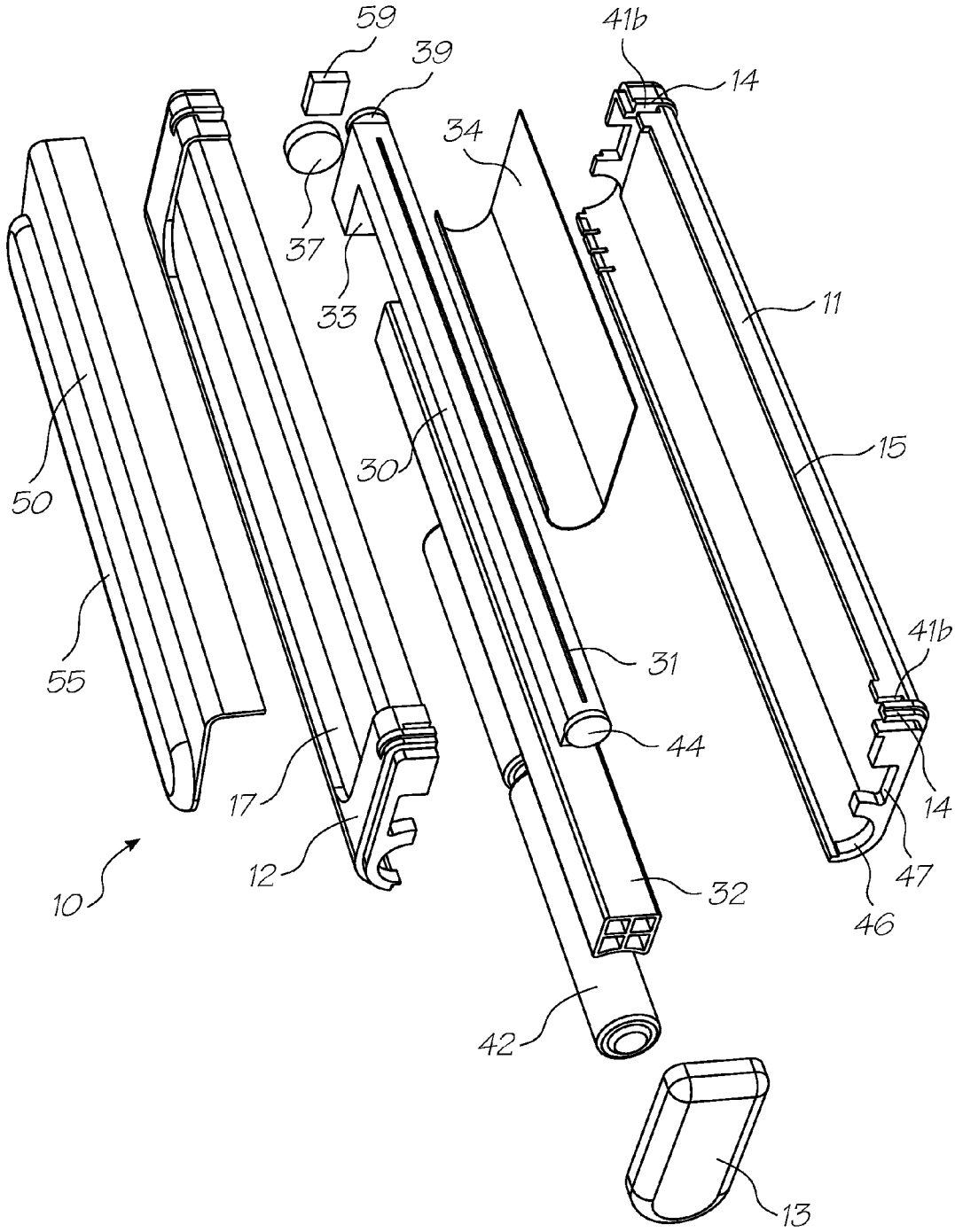
FIG. 2 is an exploded perspective view of the printer.

An exploded perspective view of the printer 10 of FIG. 1 is shown in FIG. 2. As seen in FIG. 2, the printer 10 includes a lower moulding 11, an upper moulding 12 and a removable end cap 13 each of which may be formed of any suitable plastics, metal or similar material.

The upper and lower mouldings each include media slides 14 formed on the bottom surface of each end of the mouldings. The slides 14 protrude from the bottom surface of the mouldings and serve to elevate the printer as the printer traverses the print media, resulting in minimal friction between the printhead and the print media. The slides also serve to prevent contact between the printer and freshly printed ink which could otherwise disturb the printed image.

When joined, the upper and lower mouldings reveal an ink ejection slot 15 through which ink is ejected during printing. A capping device 50, preferably of metal, is received in a recess 17 formed in the upper moulding 12. The capping device 50, pivots about a pivot point (described below) from a capped position in which a capping arm 52 of the capping device 50 blocks the ink ejection slot 15, to an un-capped position in which the ink ejection is unrestricted. Operation of the capping device 50 is effected using a finger pad 55 formed integrally with the capping device.

Internally, the printer 10 includes a printhead module 30 in which is disposed a plurality of ink distribution channels leading to an array of ink ejection nozzles 31 aligned with the ink ejection slot 15 formed between the upper and lower mouldings. An ink supply cartridge 32 stores ink, preferably in four colors, namely cyan, magenta, yellow and black, to provide for full color printing. Alternatively, or in addition, infra-red ink may be provided. The ink cartridge 32 supplies ink to the ink distribution channels of the printhead module 30 through an ink connector 33.

Any one of a number of known printhead modules and ink supply systems may be suitable for use with the present invention and thus further description of such features is omitted here. Details of printhead modules and ink supply systems suitable for use with the invention can be found in the co-pending applications listed at the start of this specification.

A print controller 36 includes a microprocessor that converts image data stored in microprocessor memory into a sequence of electrical "drop ejection" signals. The signals are communicated to the printhead module 30 in a known manner during a print operation to cause selective ejection of ink from the ink ejection nozzles 31.

The print control microprocessor 36 (not shown) communicates with external devices to receive print instructions, in particular digital image data. In the embodiment shown, digital image data may be provided to the microprocessor 36 as an infra-red (IR) signal through an IR window 59 formed in one end panel of the printer 10. An IR receiver electrically connected to the microprocessor 36 receives the data which is then stored in the processor memory. In alternative embodiments, the microprocessor may communicate through any other suitable connection such as hard wire connections to other electronic devices (such as computers, scanners, copiers, digital cameras and the like), wireless telecommunications (such as WAP and the like) or through a plug and socket connection or data port. Other information, for example print control instructions, may also be provided to the printer from external devices using the above systems. In a further embodiment, the microprocessor may have its own graphics generating capabilities.

The upper and lower mouldings provide a recess in which to receive batteries 42, for example two 1.5 V "AAA" batteries. A flexible printed circuit board (PCB) 34 has busbars (not shown) thereon that convey power from the batteries 42 to the printhead module 30, microprocessor 36 and any other powered components.

A power switch 43 formed in an end panel of the printer 10 is operated by a user to actuate the printer between powered and unpowered modes.

Figure 3:
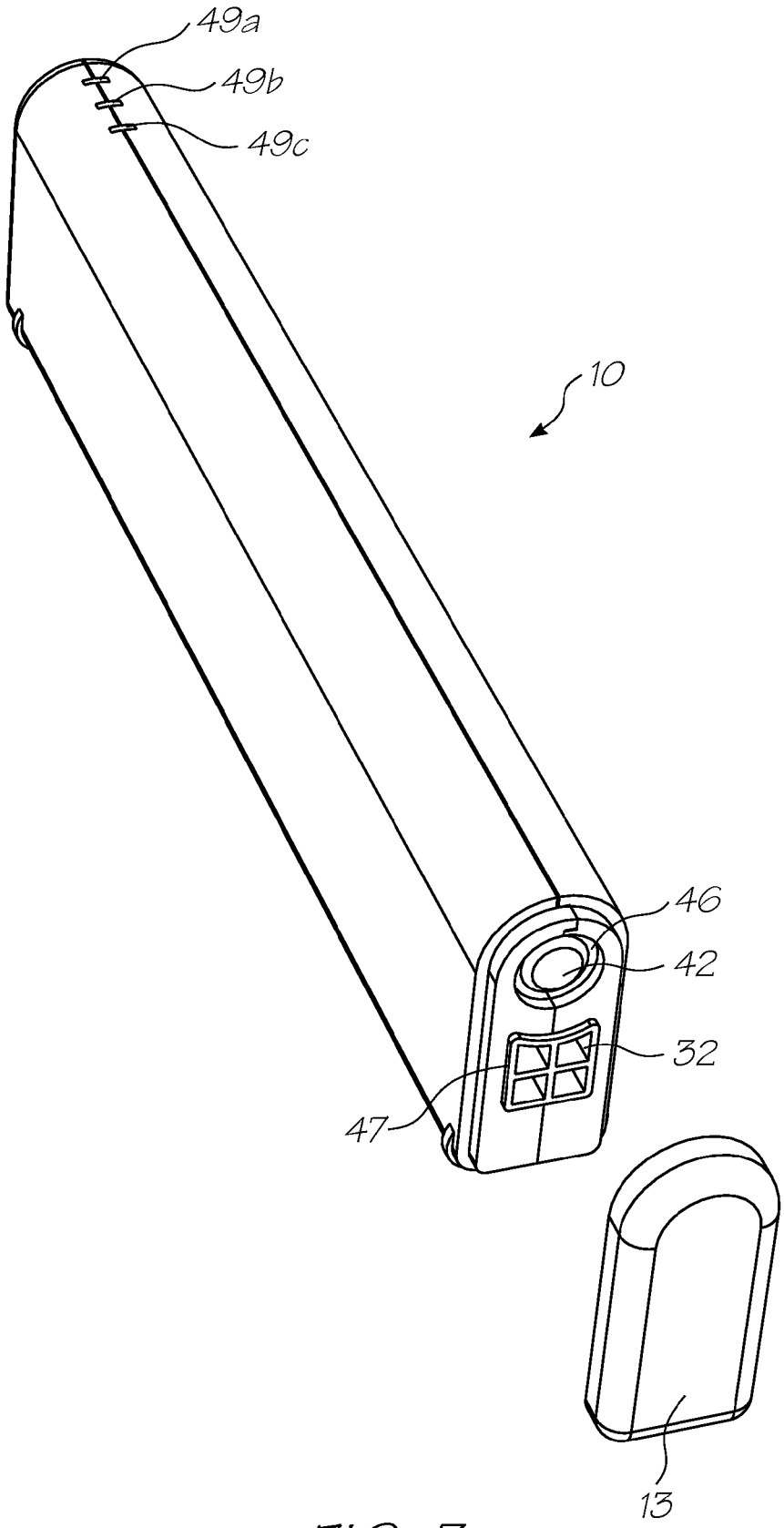
FIG. 3 is a perspective end view of the printer.

The batteries 42 are removable from the printer 10 through an aperture 46 formed between the upper and lower mouldings. The ink cartridge may be removed and replaced through a similar aperture 47. As illustrated in FIG. 3, the end cap 13 is first removed from the printer 10 to reveal the apertures 46, 47 after which the batteries and/or ink cartridge may be replaced. In a further embodiment not illustrated here, the batteries and ink cartridge may be provided as an integral unit within a removable housing with only one aperture being formed in the end of the printer 10 to receive the housing.

A plurality of status indicating light emitting diodes (LEDs) 49*a*, 49*b*, 49*c* (FIG. 3) are electrically connected to the microprocessor and are disposed in an outer surface of the printer 10. The separate LEDs can be used for indicating error conditions such as low battery, low ink or general printer operation error conditions as well as a general printer ON/OFF condition.

Figure 4:
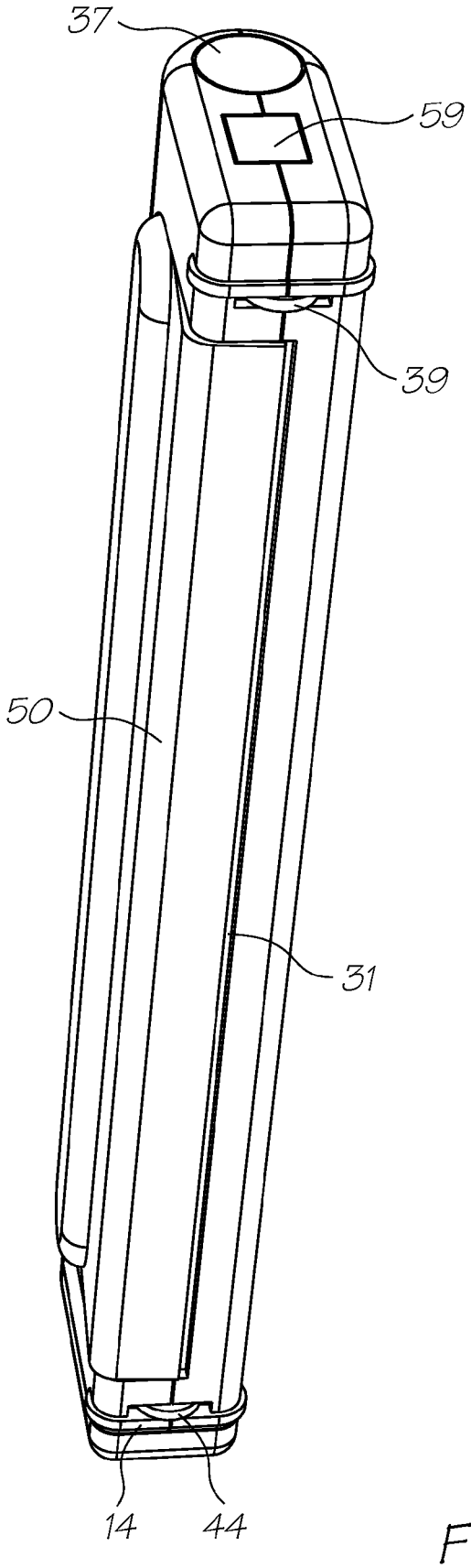
FIG. 4 is a perspective bottom view of the printer.

To perform printing, a user first actuates the capping device 50, in a manner described below, to expose the printhead chip 31 (FIG. 4) to the print media. The print media may be any suitable textile for receiving the type of ink stored in the printer and may include inter alia paper, cardboard, wood, fabric and plastics. The printer 10 may include further control buttons designed to be depressed by the user to initiate printing, i.e. to commence the ejection of ink from the printhead under the control of the print control microprocessor. Alternatively, actuation of the capping device 50 may be detected as a signal that the user is ready for the printing to commence. The user then moves the printer 10 across the print media 20 as illustrated in FIG. 1.

To control the printing rate, the printer 10 includes an optical encoder wheel 39 (FIG. 2) attached to the printhead module 30 at one end thereof. The optical encoder wheel 39 is received in slots 41*a*, 41*b* formed in the upper and lower mouldings respectively and extends from the mouldings to the point where the rim of the wheel 39 is level with the media slides 14 (see FIG. 4). Circumferentially spaced markings on the optical encoder wheel 39 are read by an optical sensor on the microprocessor 36 as the wheel 39 rotates.

The optical sensor includes a light source, such as an LED, and a photo-detector that produces an electrical response dependant upon the amount of light incident upon the detector. The light reflection characteristics of the encoder wheel 39 vary between the marked and un-marked areas and thus, as the markings rotate past the detector, a change in the detector response occurs. The frequency at which the detector response changes provides a measurement of the speed at which the encoder wheel is rotating, and therefore the speed at which the printer is moving relative to the print media. The detector response is communicated to the print control microprocessor 36 which uses the signal to calculate the speed at which the printhead module is being moved across the print media. The print controller then synchronises the rate at which the drop ejection control signals are passed to the ink ejection nozzles with the measured speed at which the printer is moving. The printer 10 is therefore able to ensure appropriate print dot spacing of successive lines of print and thus create a faithful reproduction of the printed image even though the printer does not control the speed at which the print media moves relative to the printhead.

Furthermore, if the number of markings on the encoder wheel 39 is high enough, the microprocessor 36 is able to quickly adapt to the variations in the speed at which a user may move the printer across the print media thereby achieving a higher quality image. In one embodiment, the markings on the encoder wheel are spaced in such a way that the circumferential spacing between successive markings on the wheel is substantially equal to the spacing between successive print lines in the image being printed. In this embodiment, the detection of a marking on the wheel triggers the printing of the next line of the image.

An idler wheel 44 is attached to the opposite end of the printhead module 30 to allow stability and directional control of the printer. A shaft may connect the idler wheel 44 with the encoder wheel 39 to synchronise the rotation speeds of each wheel.

The optical encoder wheel 39 or idler wheel 44 may have a speed limiter such as a friction clutch that prevents a user from moving the printer along the print media at a rate faster than the maximum rate of operation of the printhead module 30. Furthermore, either or both wheels may have a system such as a ratchet for preventing the printer from being moved in the opposite direction to the direction of printing.

Figure 5:
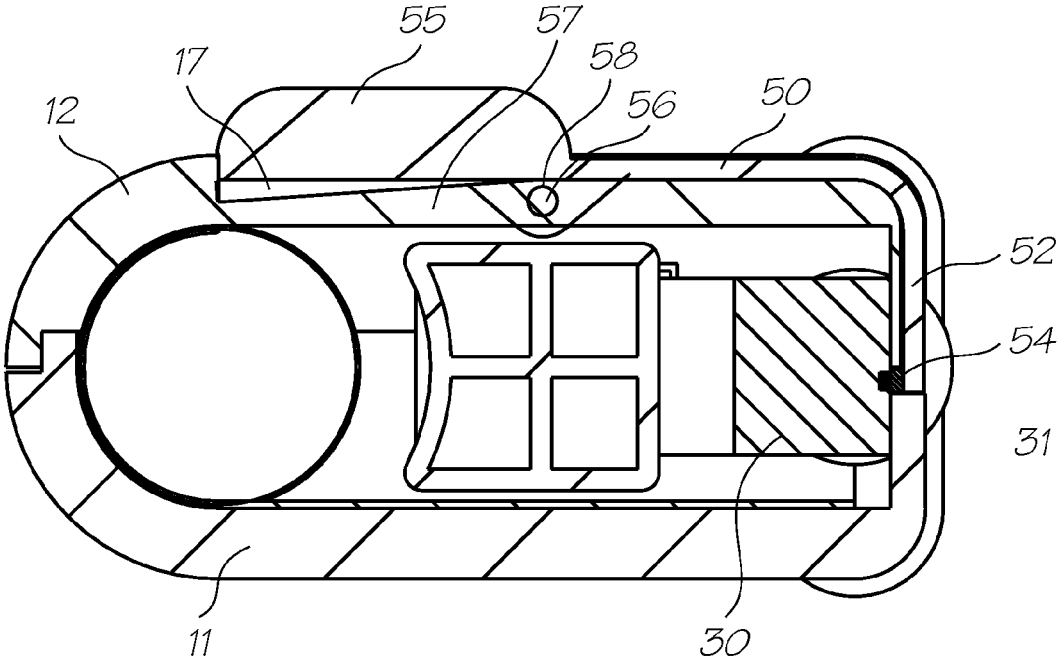
FIG. 5 is a cross section of the printer illustrating a capping device in a capped position.
Figure 6:
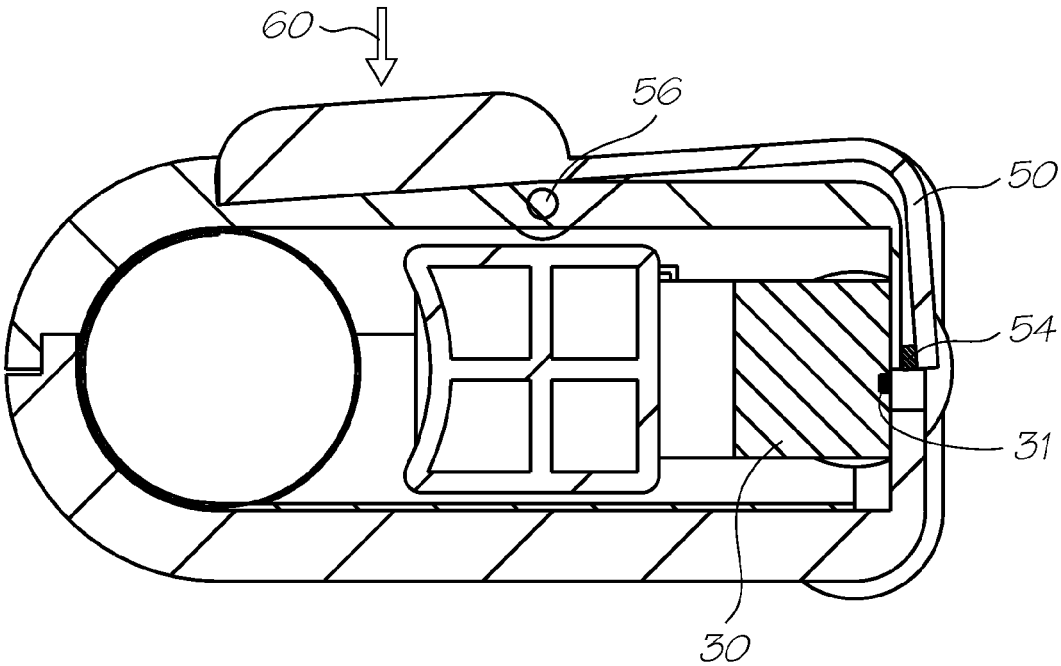
FIG. 6 is a cross section of the printer illustrating the capping device in an un-capped position.

Operation of the capping device 50 will now be described with reference to FIGS. 5 and 6. Referring first to FIG. 5 there is shown an end cross-section of the printer unit 10. The capping device 50 is disposed in a recess 17 of the upper moulding 12. The capping device 50 is a substantially L-shaped section having a mounting portion 51 received in the recess 17 and a capping arm 52 extending perpendicularly from the mounting portion. A finger pad 55 is formed along the length of the mounting portion 51.

At each end of the mounting portion 51 and on the opposite side to the finger pad 55 there extends a flange 57 having an aperture 58 therein. The aperture 58 engages a pivot 56 extending from an edge of the recess 17 to thereby mount the capping device 50 to the upper moulding 12 and at the same time allowing pivotal motion of the capping device.

When the capping device 50 is mounted to the upper moulding 12 as illustrated in FIG. 5, the capping arm 52 reaches to the printhead module 30 containing the ink ejection nozzles 31. An elastomeric pad 54 is formed on the distal end of the capping arm 52 for protecting the ink ejection nozzles. In the position shown in FIG. 5 the elastomeric pad 52 obstructs the ejection of ink from the printhead 30. Referring to FIG. 6, a user applies finger pressure to the finger pad 55 in the direction of the arrow 60 causing the capping device 50 to rotate about the pivot 56. As the capping device rotates, the capping arm moves away from the printhead 30 to a position where it no longer obstructs the ink ejection nozzles 31 and ink may successfully be ejected onto underlying print media.

The capping device 50 may further include a spring biasing the capping device 50 to the capped position when finger pressure is removed from the finger pad 55.

A contact sensor (not shown) may detect when the capping device 50 is moved to the uncapped position and communicate the state of the capping device to the print control microprocessor 36 so that printing is only attempted when the capping device 50 is in the uncapped position.

The printer 10 of the present invention may include keys for controlling the microprocessor to perform such printer operations as downloading image data from an external device, resetting an incomplete print operation so that the printer commences printing at the start of an image etc. Alternatively, these functions may be communicated to the printer through the IR data port described previously.

The invention claimed is:

1. A hand-held printer comprising:

an elongate body defining an ink ejection slot through which ink is ejected, the ink ejection slot substantially spanning a width of the elongate body on a first side thereof;

an ink cartridge received in the body and defining a plurality of ink reservoirs storing respective types of ink;

a movement sensor for sensing movement of the printhead module along print media;

a printhead module in fluid communication with respective ink reservoirs, the printhead module including a printhead for ejecting ink through the ink ejection slot in accordance with the movement sensed by the movement sensor; and a capping device hinged to a second side of the elongate body that is substantially perpendicular to the first side of the elongate body, the capping device substantially spanning a width of the elongate body and adapted to pivot to expose or cover the printhead, wherein the capping device has an actuating side and a capping side, the capping side extending substantially parallel to the first side of the elongate body and the actuating side extending substantially parallel to the second side of the elongate body, and the capping side includes an elastomeric pad at an end thereof positioned to be in contact with nozzles of the printhead when the capping device covers the printhead.

2. A printer as claimed in claim 1, wherein the body includes media slides to space the printhead module from the print media during printing.

3. A printer as claimed in claim 1, wherein the movement sensor comprises an optical encoder wheel, an optical sensor for detecting movement of the optical encoder wheel, and a processor for receiving signals from the optical sensor.

4. A printer as claimed in claim 1, wherein the body includes an indicator interface which can visually indicate operational conditions of the printer.

5. A printer as claimed in claim 1, wherein the second side of the elongate body defines a depression for partially receiving therein the actuating side of the capping device, whereby pivoting of the capping device about the second side is facilitated.

* * * * *